US005433004A

United States Patent [19]

Thompson et al.

[11] Patent Number: 5,433,004

[45] Date of Patent: Jul. 18, 1995

[54] SINGLE EDGE BLADE SCRAPER

[75] Inventors: Steven L. Thompson, Buffalo; David R. Henke, Maple Grove, both of Minn.

[73] Assignee: Warner Manufacturing Company, Minneapolis, Minn.

[21] Appl. No.: 136,305

[22] Filed: Oct. 14, 1993

[51] Int. Cl.[6] ..... A47L 13/08; B26B 29/02

[52] U.S. Cl. ..... 30/169; 30/339

[58] Field of Search ..... 30/169, 336, 337, 338, 30/339

[56] References Cited

U.S. PATENT DOCUMENTS

| | | | |
|---|---|---|---|
| 2,291,514 | 7/1942 | Warner et al. . | |
| 2,404,141 | 7/1946 | Nelson | 30/339 X |
| 2,548,797 | 4/1951 | Ingwer et al. . | |
| 2,601,723 | 7/1952 | Keller . | |
| 3,171,201 | 3/1965 | Carifi . | |
| 3,855,700 | 12/1974 | Gerson et al. | 30/169 X |
| 4,381,604 | 5/1983 | Horst | 30/169 |
| 4,558,517 | 12/1985 | Gringer . | |
| 4,612,707 | 9/1986 | Shea | 30/169 X |
| 4,706,385 | 11/1987 | Iten | 30/169 |
| 4,955,138 | 8/1990 | Henke et al. . | |
| 5,319,853 | 6/1994 | Schmidt | 30/169 |

*Primary Examiner*—Rinaldi I. Rada

*Attorney, Agent, or Firm*—Merchant, Gould, Smith, Edell, Welter & Schmidt

[57] ABSTRACT

A blade scraper including a housing having a top cover case and a bottom containing case, a resilient trigger assembly generally disposing in the housing and a finger-actuating portion of the trigger assembly projecting from the housing through an elongated slot on the top cover case, and a scraping blade secured at a front end of the trigger assembly. The trigger assembly includes projections biasedly inserted into slots on the top cover case of the housing. The blade scraper is operated among a blade loading position, a blade scraping position and a blade storing position.

17 Claims, 8 Drawing Sheets

SINGLE EDGE BLADE SCRAPER

FIELD OF THE INVENTION

The present invention relates to a single edge blade scraper device.

BACKGROUND OF THE INVENTION

In scraping paint, adhesives, compounds and decals from a surface such as glass windows, a single edge blade scraper is used. A single edge razor blade which is usually used for shaving is used as a blade in the blade scraper. It is a concern to be able to safely mount the blade onto the blade scraper as the blade is frequently replaced by a user.

Another concern is that the blade scraper can be easily controlled and operated so as to effectively scrape the paint or other decals from the surfaces.

One hand scraper tool is disclosed in U.S. Pat. No. 2,291,514 to Warner et al. A blade of the hand scraper tool is clamped between two spring-biased pieces at a front end of the hand scraper tool. The blade is removed and/or mounted in the clamp by the use of one's hand.

Another hand scraper tool is disclosed in U.S. Pat. No. 4,558,517 of Gringer. The Gringer scraper uses a resilient I-beam structure for locking the scraper in different positions for storing, scraping or mounting the blade. However, in Gringer, it is often difficult to move the mechanism between the storing, scraping and mounting positions because an operator has to use a significant force to push down the whole I-beam which oppositely bends toward the scraper, so as to release the locking means of the mechanism from the scraper locking means.

The Gringer scraper teaches the same general clamp structure as the Warner's hand scraper tool. Also, there is no handle grip portion in Gringer for the operator to grab the scraper while scraping.

U.S. Pat. No. 4,955,138 to Henke et al. discloses a utility blade scraper which does not use a clamp with two sprint-biased pieces. However, this scraper does not use a razor blade design.

The present invention provides an improved blade scraper that provides many improvements over the prior art.

SUMMARY OF THE INVENTION

The present invention relates to a single edge blade scraper.

One embodiment of the present invention relates to a single edge blade scraper including a housing having a top cover case and a bottom containing case, a trigger mechanism generally disposed in the housing having locking means and trigger actuating means which cooperate with the top cover case of the housing, arm portions symmetrically disposed beside the trigger actuating means, and a scraping blade mounted and secured at a front end of the trigger assembly between the top cover case and the trigger assembly.

In one embodiment, the locking means are disposed on the arm portions. The projections are received in apertures in the top cover case so that the trigger mechanism is locked in a position defined by the apertures.

In an alternative embodiment, the locking means, which is independent from the arm portions, is integral with the trigger actuating means. The projections are received in the top cover case so that the trigger mechanism is locked in a position defined by the apertures.

One advantage of one embodiment of the present invention is that it provides a front loading trigger assembly to releasably receive and retain the blade in place without requiring force to slide the blade in from the side. Therefore, the safety factor of mounting and/or removing the blade is increased. Further, the simple design of the configuration at the front end of the trigger assembly allows the operator to easily load blade scraper.

An advantage of one embodiment of the present invention is that it provides a handle portion for grabbing the blade scraper so that the operator can effectively scrape the surfaces.

Yet another advantage of one embodiment of the present invention is that since the blade is secured at the front end of the trigger assembly, movement of the blade relative to the housing is substantially eliminated. It also prevents the blade from being pulled out of the blade scraper should the blade scraper become stuck during the scraping process.

One embodiment of the present invention relates to a blade scraper for scraping adhesives and decals from a surface, comprising:

- a housing having a top cover case and a bottom containing case;
- a trigger assembly, being disposed in the housing, resiliently biased upward toward the top cover case, the trigger assembly having trigger actuating means projecting from the housing through an elongated slot disposed in the top cover case;
- retaining means for releasably retaining a blade on a front end of the trigger assembly;
- means for locking the trigger assembly in a plurality of positions relative to the housing; and
- wherein the retaining means includes a blade support portion at the front end of the trigger assembly having a recessed portion to receive a blade reinforcement portion of the blade, two blade holding tabs, which project from the blade support portion towards the top cover case, receiving corresponding side slots of the blade so that lateral and vertical movements of the blade relative to the trigger assembly are prohibited.

These and various other advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings in which like reference numerals and letters generally indicate corresponding parts throughout the several views.

DETAILED DESCRIPTION OF THE PREFERRED EMBODIMENT

Figure 1:
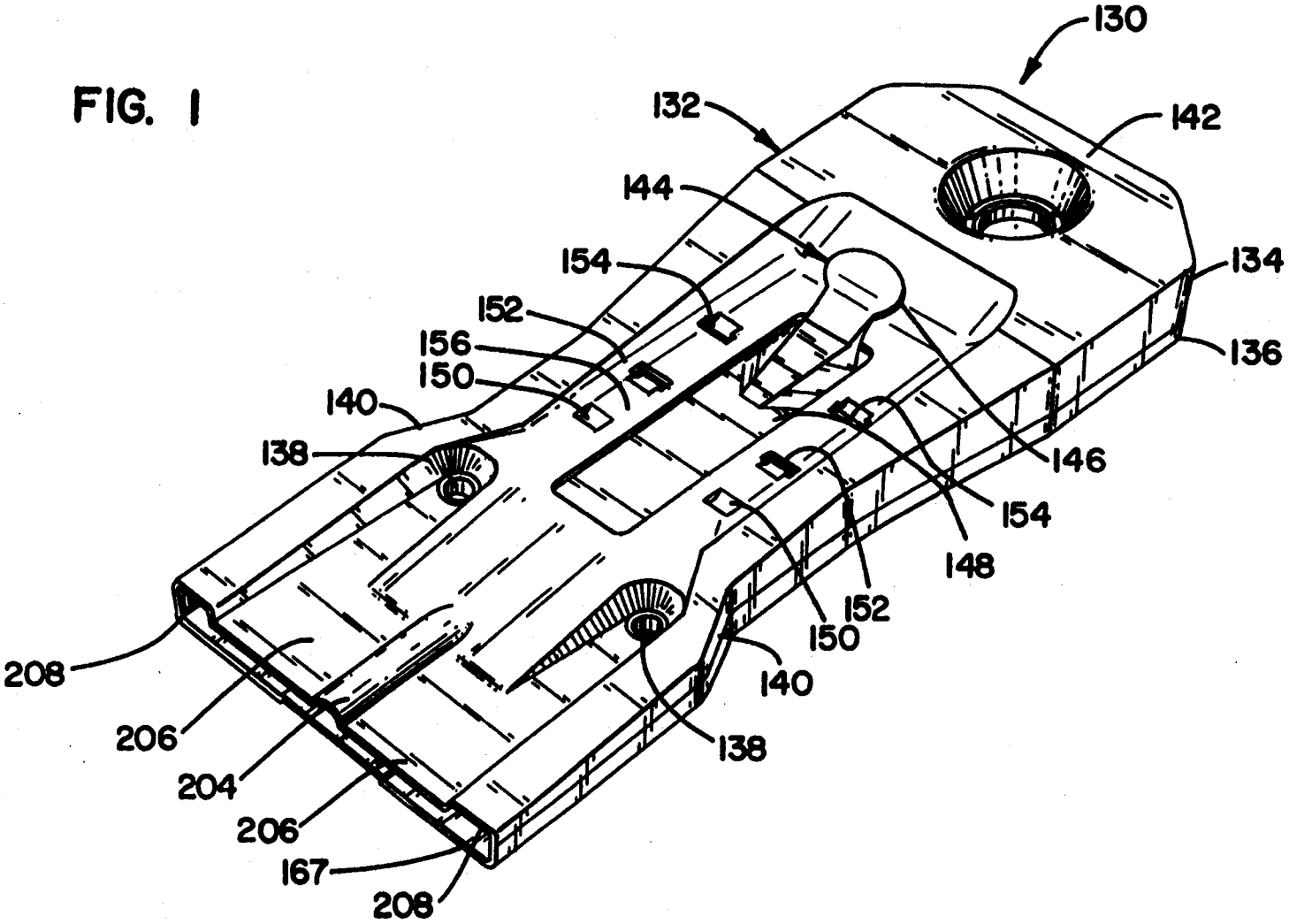
FIG. 1 is a perspective view of an embodiment of a single edge blade scraper generally in accordance with the principles of the present invention.

As shown in FIG. 1, an embodiment of a single edge blade scraper 130, generally in accordance with the principles of the present invention, includes a housing 132 defined by a top cover case 134 and a bottom container case 136. The top cover case 134 and the bottom container case 136 are loaded together by staking or riveting. In the embodiment shown, staking projections 138,141 are inserted through apertures 139,142, respectively, and then rolled over by an anvil or other suitable press devices (not shown). Alternatively, the top cover case 134 and the bottom containing case 136 can be mounted together by any other types of methods such as welding, adhesives, etc.

Figure 2:
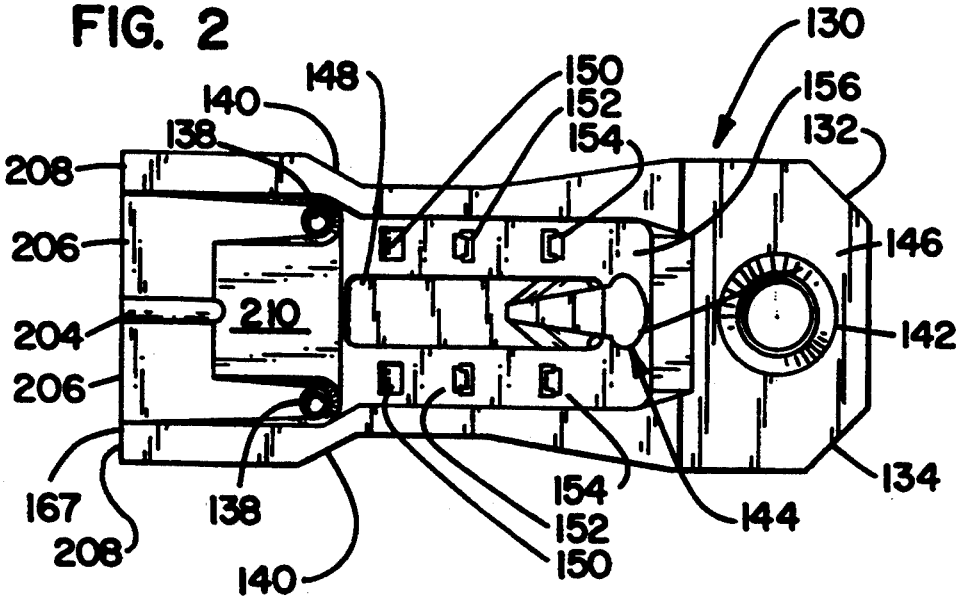
FIG. 2 is a top plan view of the embodiment of the single edge blade scraper shown in FIG. 1.
Figure 3:
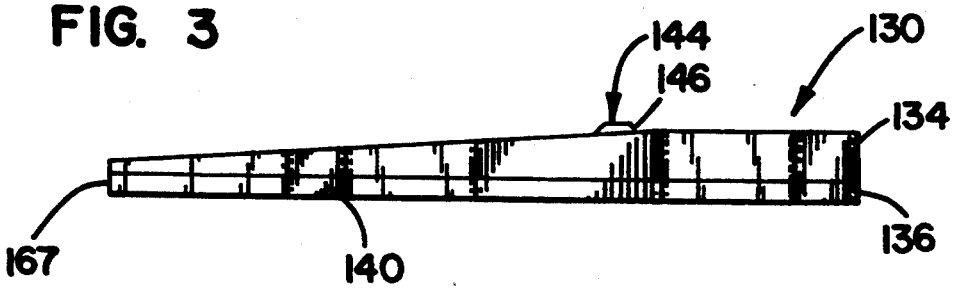
FIG. 3 is an elevated side view of the embodiment of the single edge blade scraper shown in FIG. 1.

The housing 132 is molded to have a handle portion 140 providing a surface for an operator's hand to tightly grab the blade scraper 130 so that the operator can effectively scrape a surface. This configuration, which is further shown in FIGS. 2–4, prevents the slippage between the operator's hand and the blade scraper 130.

A hole 142 extending through the housing is disposed proximate a back end of the housing 132 for hanging and/or displaying the blade scraper 130.

A resilient, upward-biased trigger mechanism 144, which is disposed in the housing 132 between its ends, has an integral trigger actuating portion 146 projecting from the housing 132 through an elongated slot 148 on the top cover case 134. The trigger mechanism 144 can be moved along the elongated slot 148 when the trigger actuating portion 146 is actuated by pressing down on the trigger actuating button 146. The trigger mechanism 144 extends out of a front end 167 of the housing 132 when the trigger mechanism 144 is pushed down and moved along the elongated slot 148 toward the front end 167 of the housing 132. The trigger mechanism 144 is also moved along inner sides of the housing 132. The minimum inside space separating the inner sides of the housing 132 is slightly larger than the maximum outside width of the corresponding portion of the trigger mechanism 144 so that no interference occurs when the trigger mechanism 144 is moved along the inner sides of the housing 132.

Figure 4:
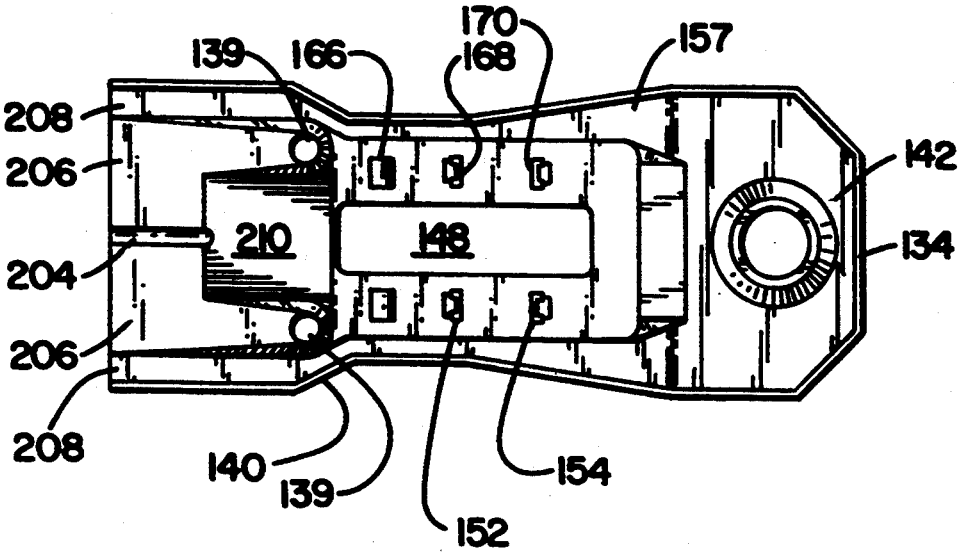
FIG. 4 is a bottom plan view of a top cover case of the single edge blade scraper.
Figure 10:
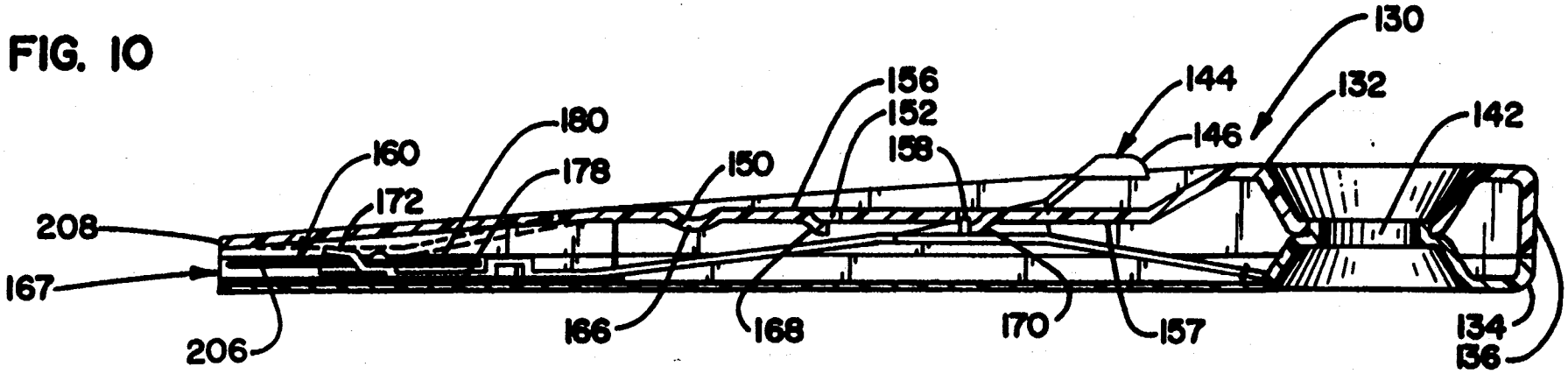
FIG. 10 is longitudinal cross-sectional view of the single edge blade scraper in a storing position.
Figure 11:
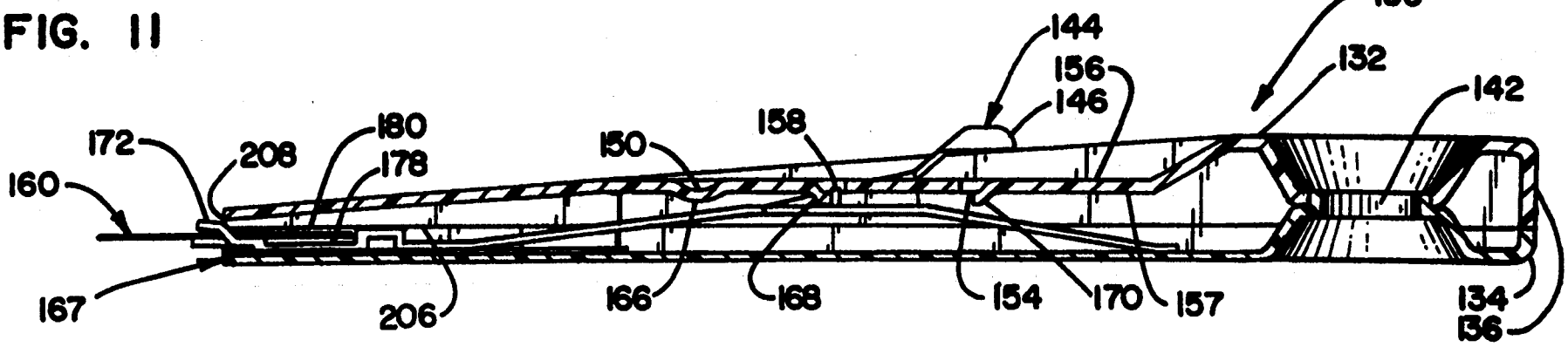
FIG. 11 is longitudinal cross-sectional view of the single edge blade scraper in a scraping position.
Figure 12:
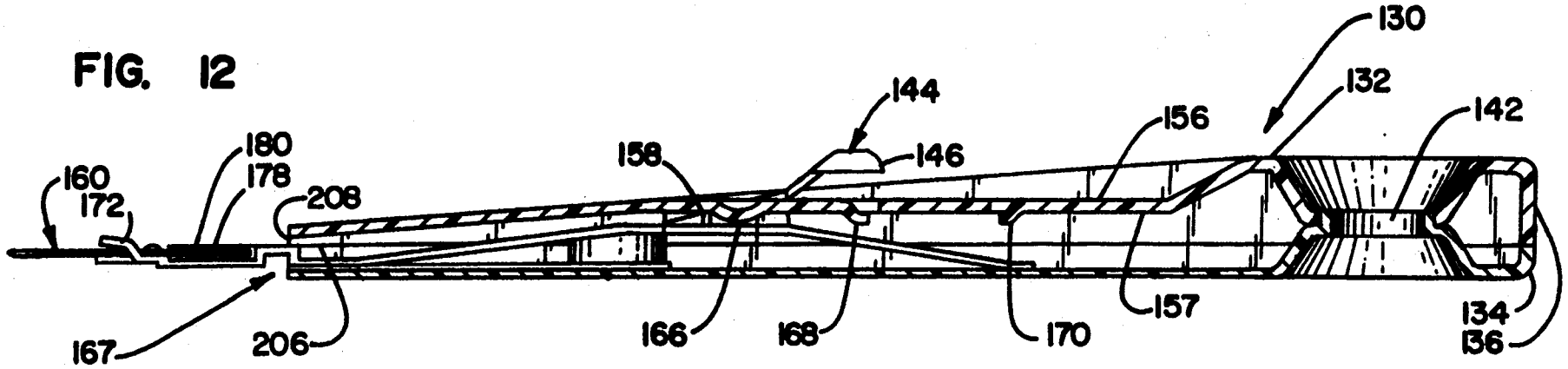
FIG. 12 is longitudinal cross-sectional view of the single edge blade scraper in a loading position.

There are a pair of indentations 150 and two pairs of apertures 152,154 disposed on a surface 156 of the top cover case 134. Each pair of indentations 150 and apertures 152,154 are symmetrically disposed beside the elongated slot 148. A pair of vertical projections 158 (shown in FIG. 5), which are integral with the trigger mechanism 144, are received in the apertures 154 of the top cover case 134 when the trigger mechanism 144 is placed in a blade storing position as shown in FIG. 10 (hereinafter apertures 154 are called blade storing apertures 154). The vertical projections 158 are received in the apertures 152 of the top cover case 134 when the trigger mechanism 144 is placed in a blade scraping position as shown in FIG. 11 (hereinafter apertures 152 are called blade scraping apertures 152). The vertical projections 158 are disposed in front of the stop members 166 formed by the opposite under side of the indentations 150 of the top cover case 134 when the trigger mechanism 144 is placed in a blade loading position as shown in FIG. 12 (hereinafter indentations 150 are called blade loading indentations). FIG. 4 is the bottom plan view of the top cover case 134 showing the apertures 152, 154 and the stop members 166. Alternatively, the apertures 152,154 can be molded in any type of shape, such as U shape, etc.

As the vertical projections 158 slide under the stop members 166 of an inner surface 157 of the top cover case 134, the operator notices an increased resistance to the movement of the trigger mechanism 144. Thus, the operator knows that the trigger mechanism is approaching the blade loading position. Moreover, the stop members 166 prevent the trigger mechanism 144 from inadvertently being moved toward the front end 167 of the housing 132 into the blade loading position.

In the blade loading position, a blade support portion 162 of the trigger mechanism 144 projects a certain distance out of the front end 167 of the housing 132, whereby a blade 160 can be loaded onto the blade scraper 130.

Stop members 168, which are extended downwardly from the inner surface 157 of the top cover case 134, are angled to guide the trigger mechanism 144 into the apertures 152 wherein the apertures 152 are disposed behind the stop members 168 relative to the front end 167 of the housing 132. When the trigger mechanism 144 is placed into the apertures 152, a small portion of the blade support portion 162 and the blade 160 extend from the housing 132 whereby the blade scraper 130 is in the scraping position.

Stop members 170, which are extended downwardly from the inner surface 157 of the top cover case 134, are angled to guide the trigger mechanism 144 into the apertures 154 wherein the apertures 154 are disposed before the stop members 170 relative to the front end 167 of the housing 132. When the trigger mechanism 144 is placed into the slots 154, the blade support portion 162 and the blade 160 are retracted into the housing 132 whereby the blade scraper 130 is in the storing position. Thus, the stop members 166,168,170 assist in assuring proper positioning of the trigger mechanism 144 in its three basic positions.

Figure 7:
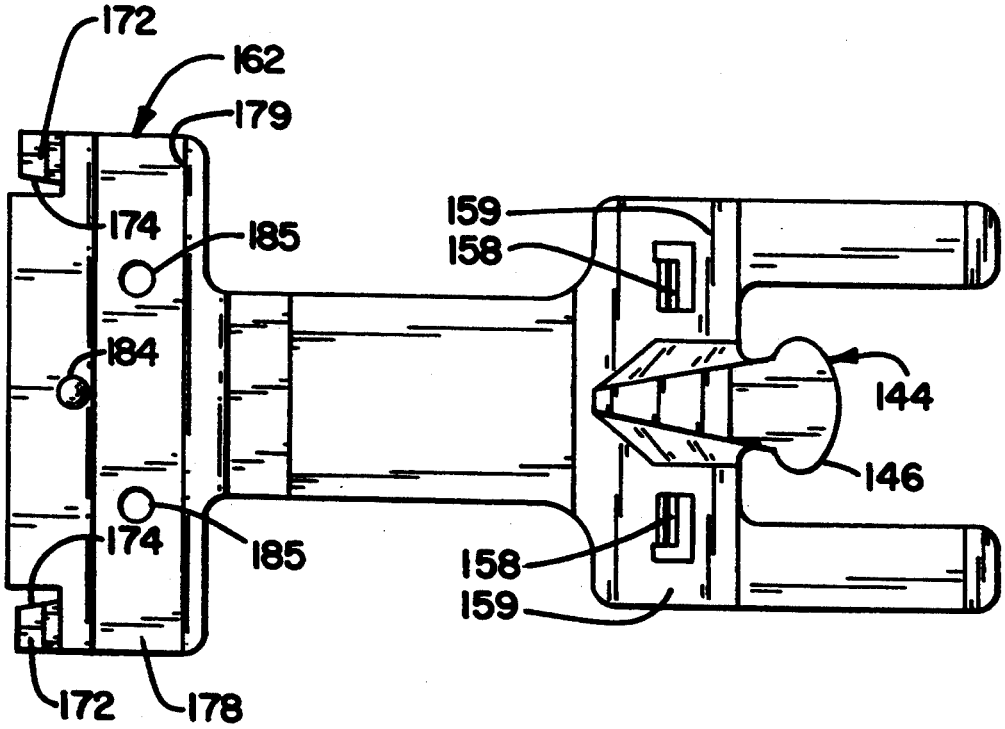
FIG. 7 is a top plan view of a trigger mechanism.
Figure 8:
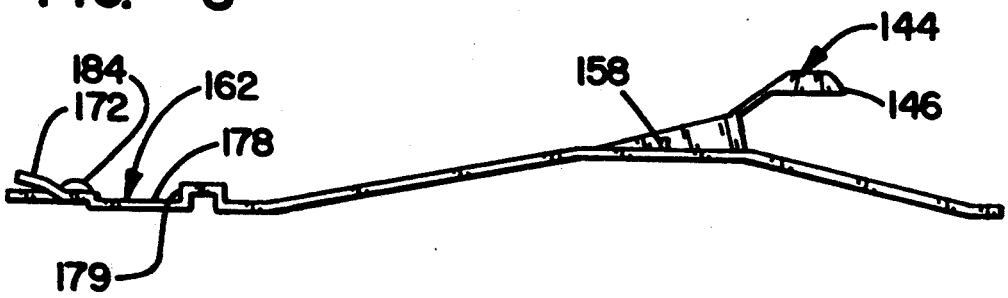
FIG. 8 is an elevated side view of the trigger mechanism.

As shown in FIGS. 7,8, the trigger mechanism 144 includes the projections 158 disposed on two symmetrical arms 159, which are not integral with the trigger actuating portion 146. When the trigger actuating portion 146 is pushed down, the trigger mechanism 144 is bent downwardly so that the projections 158 are caused to exit the blade scraping slots 152 or the blade storing slots 154 or disengage from the stop members 166 on the inner surface 157 of the top cover case 134.

Figure 13:
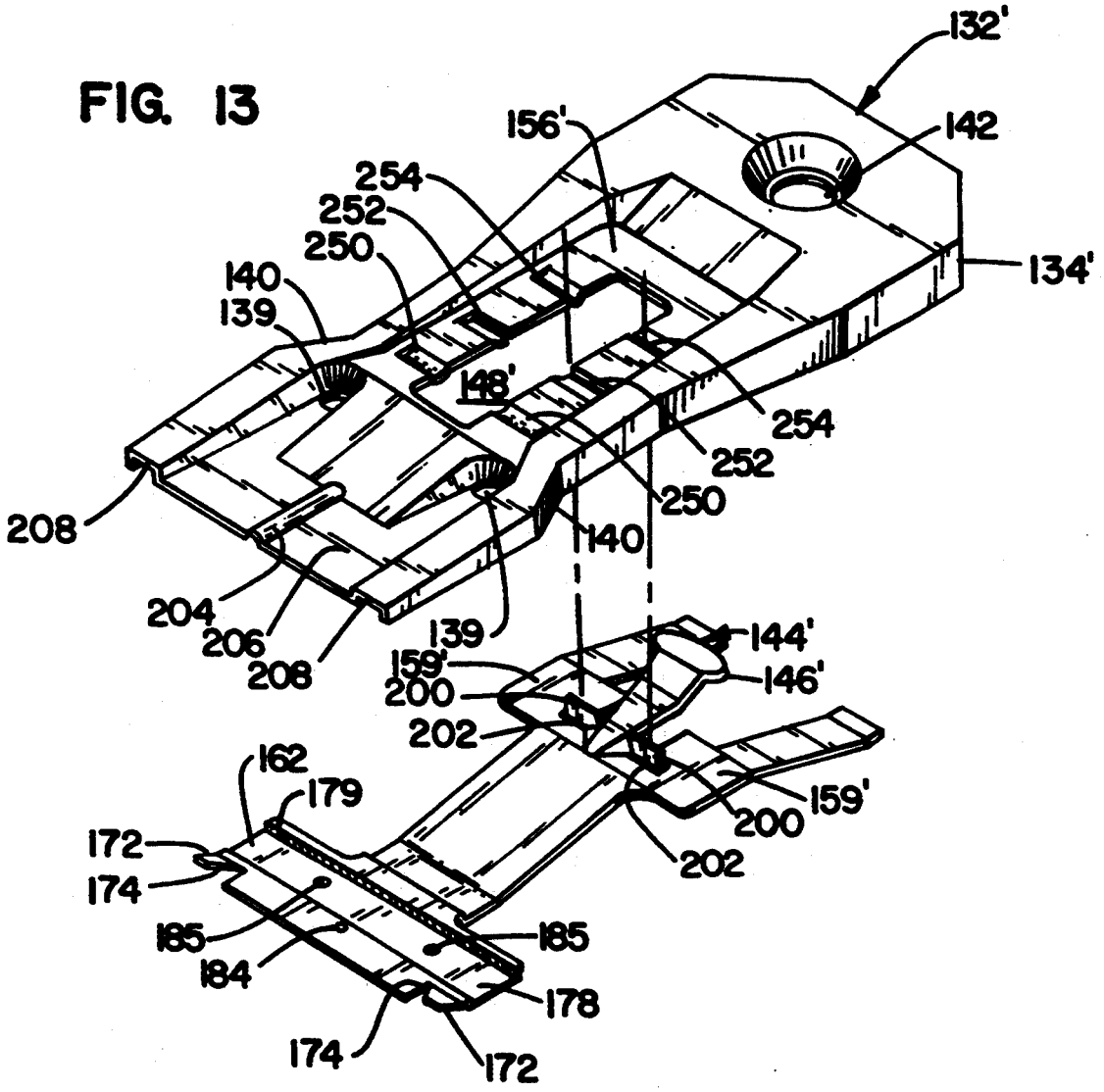
FIG. 13 is an exploded view of an alternative embodiment showing the trigger mechanism having projections being independent from arm portions and being integral with a trigger actuating portion.

In FIG. 13, an alternative embodiment shows the trigger mechanism 144'. To avoid using the same reference numeral to designate different parts, the parts, which are the same as those in the first embodiment of the trigger mechanism 144, are designated by the same reference numerals. The parts, which are similar to those in the first embodiment of the trigger mechanism 144, are designated by the same reference numerals but also adding "'" after the reference numerals. In FIG. 13, the trigger mechanism 144' includes two projections 200, which have the same function as the projections 158 in the first embodiment of the trigger mechanism 144. The projections 200 are integral with each side of a trigger actuating portion 146' and are independent from arm portions 159'. Two slots 202 on the inner side of the arm portions 159' are used to structurally receive the projections 200. Accordingly, the blade scraping apertures 152 (reference no. 252 in FIG. 13), the blade storing apertures 154 (reference no. 254 in FIG. 13) and the indentations 150 (reference no. 250 in FIG. 13) are designed to be in communication with an elongated slot 148' which corresponds to the elongated slot 148 in the first embodiment. Thus, when the trigger actuating portion 146' is pushed down, the projections 200 are released from the blade scraping apertures 252 or the blade storing apertures 254 or disengaged from the stop members 166. The trigger mechanism 144' is allowed to move in a housing 132' without bending the whole trigger mechanism 144' so that the resistance to moving the trigger mechanism 144' is dramatically reduced.

Figure 5:
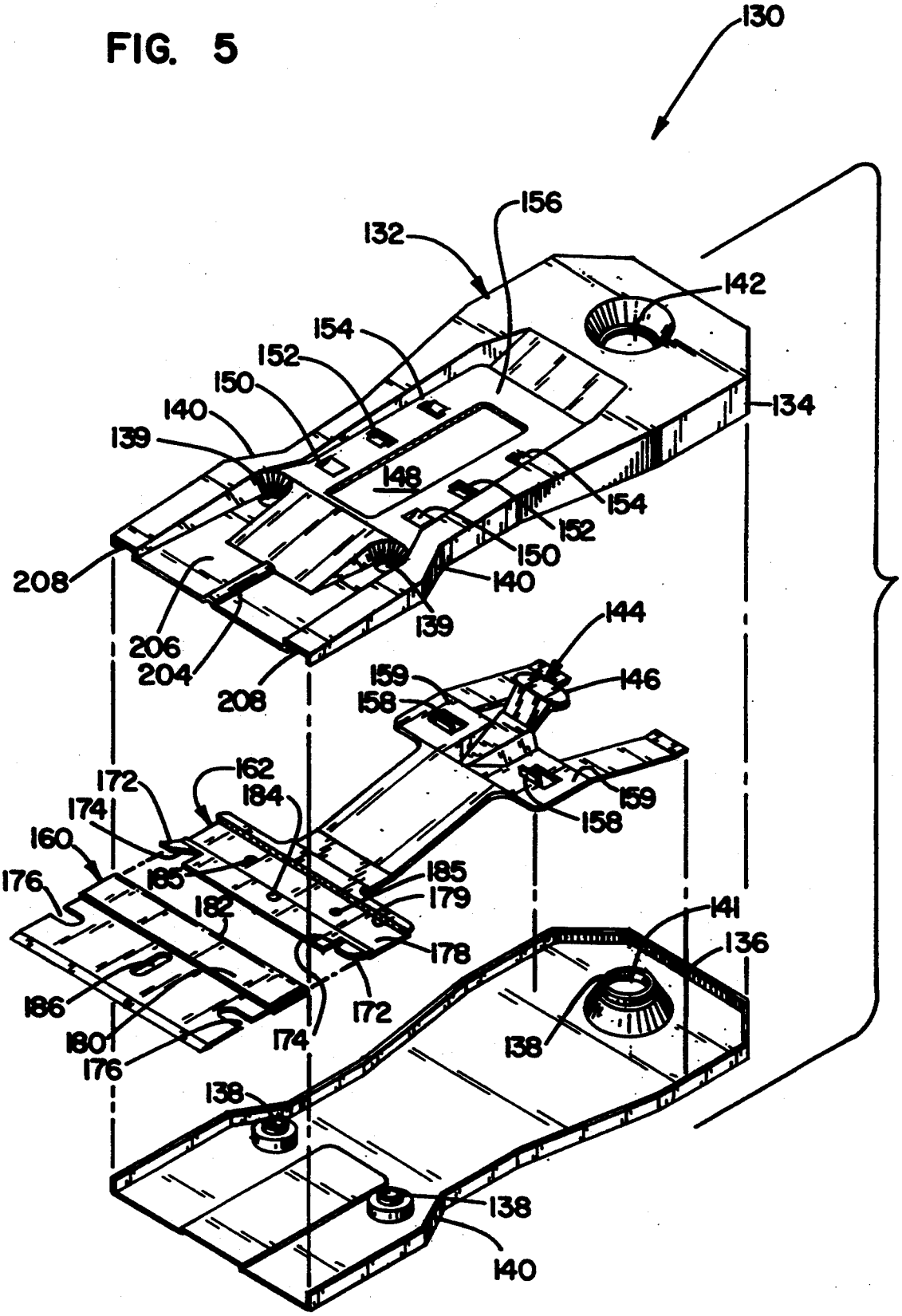
FIG. 5 is an exploded view of the single edge blade scraper shown in FIG. 1.
Figure 6:
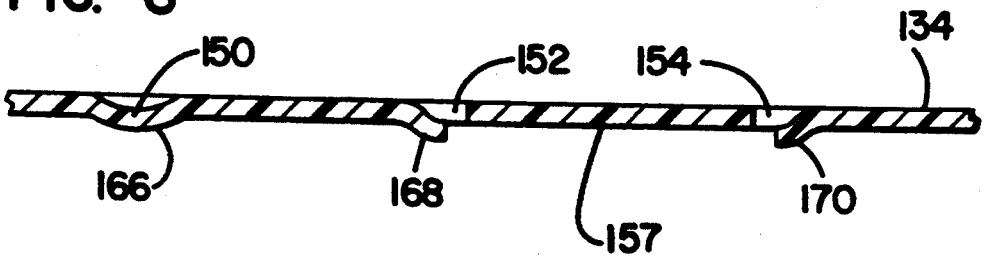
FIG. 6 is an enlarged partial longitudinal cross-sectional view showing slots and stops of the top cover case.
Figure 9:
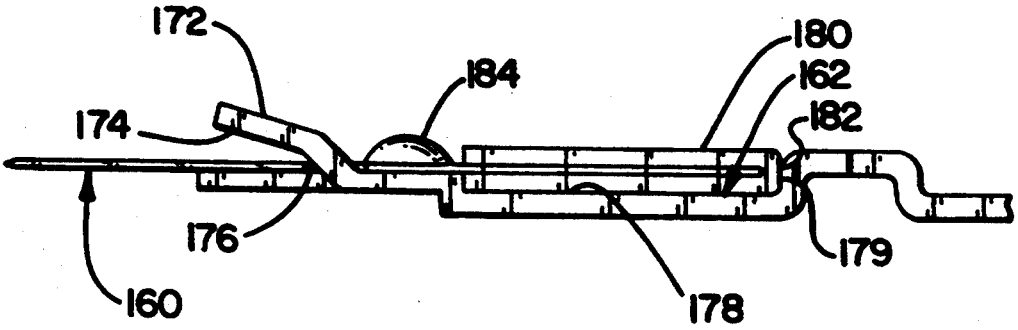
FIG. 9 is an enlarged elevated side view of a blade loaded onto a front end of the trigger mechanism.

As shown in FIG. 9, the blade 160 is loaded onto the blade support portion 162 of the trigger mechanism 144 (only part of the trigger mechanism 144 is shown). FIG. 5 shows a perspective view of the trigger mechanism 144 and the blade 160. Two blade holding tabs 172 are symmetrically projected from two sides of the blade support portion 162 toward the top cover case 134. The blade holding tabs 172 are tapered on inside edges 174 of the tabs 172 so as to allow the corresponding side slots 176 of the blade 160 easily fit over the tabs 172 and then to tighten up as the blade 160 is set into place. Thus, lateral movement of the blade 160 relative to the trigger mechanism 144 is prohibited. The blade holding tabs 172 are further bent toward an upper surface of the blade 160 to the extent that the tabs 172 fit through the side slots 176 of the blade 160 so that vertical movement of the blade 160 relative to the trigger mechanism 144 is prohibited.

When the trigger assembly 144 is retracted into the housing 132 and disposed in the scraping position, a blade reinforcement portion 180 of the blade 160 which is received in the blade support portion 162 contacts with inner surface of flat portions 206 of the top cover case 134. This contact prevents the blade 160 from sliding over the holding tabs 172. Thus, a forward horizontal movement of the blade 160 relative to the trigger assembly 144 is restricted by the flat portions 206 and the trigger assembly 144 at the front end 167 of the housing 132. In the preferred embodiment, a central projection 184, which is disposed in front of a recessed portion 178 of the blade support portion 162, is received into an elongated central slot 186 of the blade 160. The central projection 184 further prevents the blade 160 from being pulled out of the blade support portion 162. In addition, the diameter of the central projection 184 fits into the width of the elongated central slot 186 of the blade 160 so that lateral movement between the blade 160 and the blade support portion 162 is further prohibited.

The recessed portion 178 of the blade support portion 162 receives the blade reinforcement portion 180 of the blade 160. A back wall 182 of the blade reinforcement portion 180 engages a back wall 179 of the recessed portion 178 to prevent the blade 160 from moving back from the front end 167 of the housing 132 and further helps the tabs 172 retain the blade 160 in place. Therefore, the blade 160 is substantially secured against any movement by the blade support portion 162.

Alternatively, a pair of alignment holes 185 are disposed in the recessed portion 178 for an automatic assembling machine to easily grab the trigger mechanism 144.

To assemble the scraper, the trigger mechanism 144, is placed into the bottom container case 136 of the housing 132. The top cover case 134 is then placed over the trigger mechanism 144. The top cover case 134 at the front end 167 is molded to have a central groove 204 for receiving the central projection 184 of the blade support portion 162, two symmetrical flat portions 206 for engaging with the upper surface of the blade reinforcement portion 180 so as to enhance the rigidity of the scraping blade 160, and two symmetrical slots 208 for receiving the tabs 172. The central groove 204, the flat portions 206, and the slots 208 allow the trigger mechanism 144 to store in and project from the housing 132 and also provide support to the blade support portion 162 to prevent the blade 160 from sliding out of the blade scraper 130. In addition, the trigger mechanism 144 is biased upward toward the top cover case 134 of the housing 132 and between front and back ends of the housing 132. The trigger mechanism 144 is then pushed to the blade loading position so that the blade 160 is loaded by readily placing the blade 160 into the blade support portion 162 of the trigger mechanism 144.

FIGS. 10–12 show three operating positions of the blade scraper 130. In FIG. 10, the vertical projections 158 of the trigger mechanism 144 are disposed in the blade storing apertures 154 whereby the blade 160 and the blade support portion 162 are retracted into the housing 132 so that the blade scraper 130 is stored for safety purposes. In FIG. 11, the vertical projections 158 are disposed in the blade scraping apertures 152 whereby the blade 160 and the blade support portion 162 partially project from the housing 132 so that the blade scraper 130 can be used to scrape a surface. In FIG. 12, the vertical projections 158 are abutted against the stop members 166 whereby the blade 160 and the blade support portion 162 fully project from the housing 132 so that the blade 160 can be removed and/or loaded. The blade 160 can be easily removed such that the blade 160 is removed from the recessed portion 178, the central projection 184 and the blade holding tabs 172. No extra force is required to remove and/or load the blade 160 so as to meet the safety requirement.

In operating the blade scraper 130, the operator's thumb or finger pushes down the trigger actuating portion 146, and the trigger mechanism 144 is slid from the storing position into the scraping position.

It is appreciated that the operation of the blade scraper having the second embodiment of the trigger mechanism 144' is generally the same as the operation of the blade scraper having the first embodiment of the trigger mechanism 144.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A blade scraper for scraping a surface, comprising:

a housing having a top cover case and a bottom containing case;

a trigger assembly, being disposed in the housing, resiliently biased upward toward the top cover case, the trigger assembly having trigger actuating means projecting from the housing through an elongated slot disposed in the top cover case;

retaining means for releasably retaining a blade on a front end of the trigger assembly;

means for locking the trigger assembly in a plurality of positions relative to the housing; and wherein the retaining means includes a blade support portion at the front end of the trigger assembly having a recessed portion to receive a blade reinforcement portion of the blade, two blade holding tabs, which project from the blade support portion towards the top cover case, receiving corresponding side slots of the blade so that lateral and vertical movements of the blade relative to the trigger assembly are prohibited.

2. A blade scraper in accordance with claim 1, wherein the top cover case further includes a plurality of apertures disposed beside the elongated slot.

3. A blade scraper in accordance with claim 2, wherein the locking means includes projections disposed on the trigger assembly, the projections being receivable in the apertures in the top cover case.

4. A blade scraper in accordance with claim 3, wherein the projections are vertically and upward-biasedly through the apertures in the top cover case so that the trigger assembly is locked in place by the projections on the trigger assembly being biased upward into the apertures, the trigger assembly is unlocked by pushing down the trigger actuating means whereby the projections are removed from the apertures.

5. A blade scraper in accordance with claim 2, wherein the locking means includes projections integral with the trigger actuating means, the projections being receivable in the apertures in the top cover case.

6. A blade scraper in accordance with claim 5, wherein the projections are vertically and upward-biasedly through the apertures in the top cover case so that the trigger assembly is locked in place by the projections being biased upward through the apertures, and the trigger assembly is unlocked from the slots by pushing down the trigger actuating means whereby the projections are removed from the apertures.

7. A blade scraper in accordance with claim 1, wherein the blade holding tabs are tapered on an inside edge from a front end to a back end to allow corresponding slots of the blade to fit over the front end, the back end of the holding tabs being substantially the width of the slots, so that the lateral movement of the blade is prohibited once the blade is fully inserted onto the retaining means.

8. A blade scraper in accordance with claim 1, wherein the blade holding tabs are bent toward a top surface of the blade so that the blade holding tabs fit through the slots of the blade and are angled over the top surface of the blade when it is set in place, so that the vertical movement of the blade is prohibited.

9. A blade scraper in accordance with claim 1, wherein the trigger assembly further includes a vertical wall at a back of the recessed portion, the blade support portion further including a central projection between the front end and the recessed portion so that the blade reinforcement portion of the blade is fit into the recessed portion between the central projection and the vertical wall, a backward movement relative to the trigger assembly is prohibited.

10. A blade scraper in accordance with claim 1, wherein the apertures in the top cover case include a pair of storage apertures and a pair of scraping apertures.

11. A blade scraper in accordance with claim 10, wherein angled stops, projecting toward the trigger assembly, are disposed beside the storage and scraping apertures to guide the projections of the trigger assembly into the storing and scraping apertures.

12. A blade scraper in accordance with claim 11, wherein the angled stops at the storage apertures are at back of the storage apertures relative to a front end of the housing, the angled stops at the scraping apertures are in front of the storing apertures relative to the front end of the housing.

13. A blade scraper in accordance with claim 1, wherein the trigger actuating means has a trigger actuating portion whereby the trigger assembly is bent downward when the trigger actuating portion is pushed down.

14. A blade scraper in accordance with claim 1, wherein the blade support portion further includes a central projection between the front end and the recessed portion, the top cover case including a flat portion, the blade reinforcement portion received in the recessed portion contacting with the flat portion so that a forward movement relative to the trigger assembly is prohibited.

15. A blade scraper in accordance with claim 1, further comprising a central projection disposed in front of the recessed portion being received in a corresponding central slot in the blade so that a forward horizontal movement of the blade relative to the trigger assembly is prohibited.

16. A blade scraper for scraping a surface, comprising:

a housing having a top cover case and a bottom containing case;

a trigger assembly, being disposed in the housing, resiliently biased upward toward the top cover case, the trigger assembly having an actuating trigger projecting from the housing through an elongated slot disposed in the top cover case;

the trigger assembly having a blade retaining portion, the blade retaining portion retaining a blade on a front end of the trigger assembly;

a locking mechanism, disposed on the housing, locking the trigger assembly in a plurality of positions relative to the housing; and the blade retaining portion including a recess to receive a blade reinforcement portion of the blade and two blade holding tabs which project towards the top cover case, the blade holding tabs receiving corresponding side slots of the blade so that lateral and vertical movements of the blade relative to the trigger assembly are prohibited.

17. A blade scraper in accordance with claim 16, wherein the locking mechanism includes a plurality of locking members, the trigger assembly is movable relative to the housing and is locked at a blade loading position, a blade scraping position, and a blade storing position by the corresponding locking members, the blade retaining portion extending from the housing in the blade loading position for receiving the blade so as to allow loading of the blade without having to slide the blade sideways into the housing.

* * * * *